US011946373B2

(12) United States Patent
Uddin et al.

(10) Patent No.: US 11,946,373 B2
(45) Date of Patent: Apr. 2, 2024

(54) FLOW CONTROL CHOKE WITH CURVED INTERFACES FOR WELLBORE DRILLING OPERATIONS

(71) Applicant: Halliburton Energy Services, Inc., Houston, TX (US)

(72) Inventors: Hasib Uddin, Spring, TX (US); Alben D'Silva, Edmonton (CA); Philip Park Hung Leung, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/551,523

(22) Filed: Dec. 15, 2021

(65) Prior Publication Data

US 2023/0184058 A1 Jun. 15, 2023

(51) Int. Cl.

| | |
|---|---|
| ***E21B 7/06*** | (2006.01) |
| ***E21B 4/00*** | (2006.01) |
| ***E21B 34/14*** | (2006.01) |

(52) U.S. Cl.

CPC ..... *E21B 7/06* (2013.01); *E21B 4/003* (2013.01); *E21B 7/067* (2013.01); *E21B 7/068* (2013.01); *E21B 34/14* (2013.01); *E21B 2200/02* (2020.05); *E21B 2200/06* (2020.05)

(58) Field of Classification Search

CPC ..... E21B 4/02; E21B 4/003

See application file for complete search history.

(56) References Cited

U.S. PATENT DOCUMENTS

| | | | | |
|---|---|---|---|---|
| 3,936,247 | A | 2/1976 | Tschirky et al. | |
| 3,982,859 | A | 9/1976 | Tschirky et al. | |
| 5,096,004 | A * | 3/1992 | Ide | E21B 4/02 175/320 |
| 5,351,766 | A | 10/1994 | Wenzel et al. | |
| 6,202,762 | B1 | 3/2001 | Fehr et al. | |
| 7,086,486 | B2 | 8/2006 | Ravensbergen et al. | |
| 8,011,452 | B2 * | 9/2011 | Downton | E21B 7/062 175/61 |
| 9,611,846 | B2 | 4/2017 | Underwood | |
| 9,631,674 | B2 | 4/2017 | Kirkhope et al. | |

(Continued)

FOREIGN PATENT DOCUMENTS

| | | |
|---|---|---|
| CA | 2056043 | 5/1993 |
| CN | 112031653 A | 12/2020 |
| WO | 2014195733 A2 | 12/2014 |

OTHER PUBLICATIONS

Unpublished U.S. Appl. No. 17/305,567, filed Jul. 9, 2021.

PCT App. No. PCT/US2021/063492, "International Search Report and Written Opinion", dated Sep. 7, 2022, 12 pages.

*Primary Examiner* — Robert E Fuller

(74) *Attorney, Agent, or Firm* — Kilpatrick Townsend & Stockton LLP

(57) ABSTRACT

A drilling system can be used to drill a borehole. The drilling system may include a first housing defining a main fluid flow path and a second housing defining a bypass flow path toward an annulus of a wellbore. A flow control choke may be positioned between the first housing and the second housing. The flow control choke may include a rotatable section and a stationary section that is stationary relative to the rotatable section. The stationary section may have a curved interface with the rotatable section for restricting a flow of a drilling fluid through the bypass flow path.

18 Claims, 4 Drawing Sheets

(56) References Cited

U.S. PATENT DOCUMENTS

| | | | | |
|---|---|---|---|---|
| 2005/0109542 | A1* | 5/2005 | Downton | E21B 17/1014 175/73 |
| 2005/0126826 | A1 | 6/2005 | Moriarty et al. | |
| 2018/0112466 | A1 | 4/2018 | Von Gynz-Rekowski | |
| 2019/0153820 | A1 | 5/2019 | Lorenson et al. | |

* cited by examiner

FLOW CONTROL CHOKE WITH CURVED INTERFACES FOR WELLBORE DRILLING OPERATIONS

TECHNICAL FIELD

The present disclosure relates generally to wellbore drilling operations and, more particularly (although not necessarily exclusively), to a flow control choke with curved interfaces for a wellbore drilling operation.

BACKGROUND

Directional drilling involves drilling a borehole that deviates from a vertical path, such as drilling horizontally through a subterranean formation. Rotary steerable systems can be employed to control direction of a drill bit while drilling. In a push-the-bit rotary steerable system, a pad pushes against a subterranean formation to direct the drill bit.

The push-the-bit rotary steerable system includes a mud motor with a bearing section. The bearing section may be sealed and lubricated by internal oil, or unsealed and lubricated by drilling fluid flowing through the mud motor to the drill bit. For an unsealed bearing section, loss of drilling fluid to an annulus is inevitable due to bearing tolerances, manufacturing constraints, and erosive wear from a flow of drilling fluid. The flow of drilling fluid to the annulus can be used to lubricate the bearing section, but the flow is controlled to provide pad force to steer the drill bit while avoiding excess erosion. Controlling the flow of drilling fluid to the annulus can be challenging.

DETAILED DESCRIPTION

Figure 1:
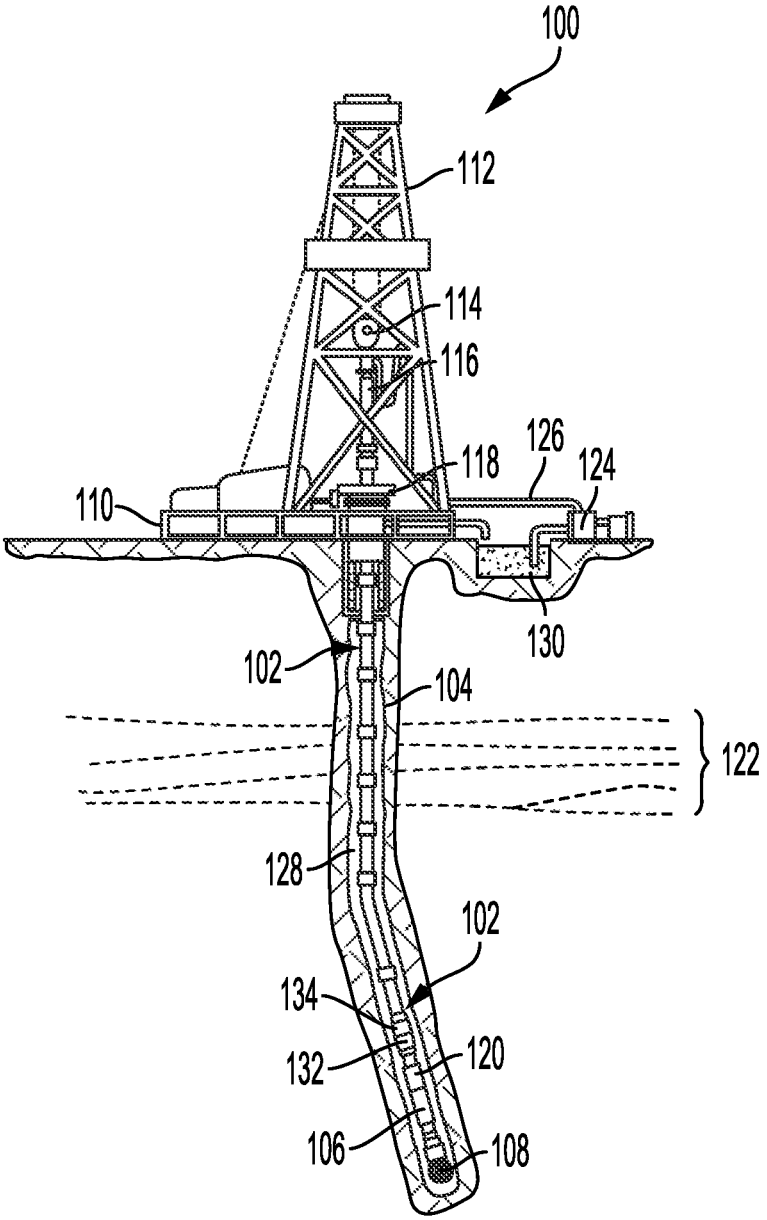
FIG. 1 is a schematic view of a drilling system with a flow control choke having a curved interface according to one example of the present disclosure.

Certain aspects and examples of the present disclosure relate to a flow control choke with a curved interface between a stationary section and a rotatable section of the flow control choke for restricting a flow of drilling fluid through a bypass flow path of a wellbore drilling assembly. The flow control choke may include a stationary section, a rotatable section, and a biasing mechanism, such as a retention spring, which may position the rotatable section against the stationary section. An aperture defined by a space between the rotatable section and the stationary section may control the amount of drilling fluid that may flow through the bypass flow path. The curved interface between the rotatable section and the stationary section may allow the sections to move freely in the event that the flow control choke experiences a bending force or a sheering force, to reduce wear and strain that the rotatable section and the stationary section may otherwise experience. The curved interface may be a juncture defined by a convex face of the rotatable section and a concave face of the stationary section. An alternative example of the curved interface may be a juncture defined by the convex face of the rotatable section and a non-matching convex face of the stationary section. Faces may be considered non-matching when the radius of one convex face differs from the radius of the other convex face. Another example of the curved interface may be a juncture defined by a convex face of the rotatable section and a flat or angled face of the stationary section.

Using a bypass flow control of an unsealed mud motor may prevent problems for providing adequate drilling fluid pressure to secondary applications of the flow of drilling fluid. Primary applications of the flow of drilling fluid may include, but are not limited to, turning a drill bit of the unsealed motor and cooling the drill bit of the unsealed mud motor. Secondary applications of the flow of drilling fluid may include, but are not limited to, extending flaps of a rotary steering system to push the drill but in a direction, cooling electronics proximal to the flow of drilling fluid, or generating electrical power via a turbine. The problems may otherwise become even more apparent when the motor is used for a motor above rotary steerable system (MARSS). In some examples of a MARSS application, tight radial bearing gaps can perform as a main restriction at a mud motor bearing section, which may control drilling fluid leakage. But, as a drilling operation progresses, a radial bearing can wear rapidly, which can reduce flow restriction and possibly cause excessive leakage. A flow control choke can mitigate the excessive leakage. But, a flow control choke with a flat face contact between a rotating choke face and a stationary section face that can prevent motion or relief under a bending or shearing force. The forces may cause wear or cause the flow control choke to malfunction. Also, the flow control choke may have tight orifices that can create a high-speed drilling fluid flow that can cause erosion as the drilling fluid flow impinges on another part of the motor that does not have proper erosion protection or that is not made out of erosion resistive material.

Some examples of the present disclosure provide a flow control choke with curved interfaces, which may control the bypass flow through the bearing section of the unsealed mud motor. The flow control choke can include a rotatable section and a stationary section, which may be arranged to keep an aperture of a flow channel constant. A surface contact may be maintained between the rotatable section and the stationary section. The surface contact may have the flow channels that can control a choking capability of the flow control choke. The curved or spherical interface of the flow control choke may allow the rotatable section and the stationary section to freely move with respect to each other in response to bending forces or other forces such that wear may be reduced and the life of the system may be extended. The flow control choke can include an anti-rotation mechanism that can prevent the rotatable section from rotating with respect to a driveshaft of a drilling assembly. The flow control choke may have a ledge portion that may prevent an incoming high-speed flow of drilling fluid from impinging on a sleeve proximate to the flow control choke. The rotational section of the flow control choke, the stationary section of the flow control choke, and the ledge portion of the flow control choke may be made from a corrosion resistant material. The ledge portion of the flow control choke, alternatively, may be made from a ductile metal coated with a corrosion resistant material. Examples of corrosion resistant material can include, but are not limited to, a tungsten carbide-based compound or a cobalt chrome-based compound.

The rotatable section, the stationary section, and the ledge portion may be arranged with respect to each other such that the flow of drilling fluid through the flow control choke may contact the corrosion resistant material and avoid contacting non-corrosion resistant material portions, to the extent any are present in the flow control choke. The ledge portion may have a minimum length so that a high speed jet flow of drilling fluid may become regularized such that the flow of drilling fluid through flow control choke may lose enough energy to prevent erosion on the sleeve positioned proximate to the flow control choke. The flow control choke may allow for various port dimensions and port numbers. The flow control choke may use a taper design to maintain the stationary section according to the direction of positive pressure coming from flow choking mechanism and the biasing mechanism.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a schematic view of a drilling system 100 with a flow control choke having a curved interface according to one example of the present disclosure. The drilling system 100 can direct a drill bit in drilling a wellbore, such as a subsea well or a land well. Although the drilling system 100 is described with reference to drilling wellbore for extracting oil, drilling systems according to various examples of the disclose can be used for drilling other types of wellbore, such as natural gas wellbores, other hydrocarbon wellbores, or wellbores in general. Further, various examples can be used for exploring and forming geothermal wellbores intended to provide a source of heat energy instead of hydrocarbons.

FIG. 1 shows a drill string 102 disposed in a directional borehole 104. The drill string 102 includes a push-the-bit rotary steerable system (RSS) 106 that can provide full directional control of the drill bit 108. A drilling platform 110 supports a derrick 112 having a traveling block 114 that may raise and lower a drill string 102. A kelly bushing 116 supports the drill string 102 as the drill string 102 may be lowered through a rotary table 118. Alternatively, a top drive can be used to rotate the drill string 102 in place of the kelly bushing 116 and the rotary table 118. A drill bit 108 is positioned at the downhole end of the drill string 102 and can be driven by rotation of the entire drill string 102 from the surface or by a downhole motor 120 positioned on the drill string 102. As the bit 108 rotates, the bit 108 may form the borehole 104 that passes through various formations 122. A pump 124 may circulate drilling fluid through a feed pipe 126 and downhole through the interior of drill string 102, through orifices in drill bit 108, back to the surface via the annulus 128 around drill string 102, and into a retention pit 130. The drilling fluid may transport cuttings from the borehole 104 into the pit 130 and may aid in maintaining the integrity of the borehole 104. The drilling fluid may also drive the downhole motor 120.

The drill string 102 may include one or more logging while drilling (LWD) or measurement-while-drilling (MWD) tools 132 that can collect measurements relating to various borehole and formation properties as well as the position of the bit 108 and various other drilling conditions as the bit 108 extends the borehole 104 through the formations 122. The LWD/MWD tool 132 may include a device for measuring formation resistivity, a gamma ray device for measuring formation gamma ray intensity, devices for measuring the inclination and azimuth of the drill string 102, pressure sensors for measuring drilling fluid pressure, temperature sensors for measuring borehole temperature, etc.

The drill string 102 may also include a telemetry module 134. The telemetry module 134 may receive data provided by the various sensors of the drill string 102 (e.g., sensors of the LWD/MWD tool 132), and may transmit the data to a surface unit 136. Data may also be provided by the surface unit 136, received by the telemetry module 134, and transmitted to the tools (e.g., LWD/MWD tool 132, rotary steering tool 106, etc.) of the drill string 102. Mud pulse telemetry, wired drill pipe, acoustic telemetry, or other telemetry technologies known in the art may be used to provide communication between the surface control unit 136 and the telemetry module 134. The surface unit 136 may also communicate directly with the LWD/MWD tool 132 or the rotary steering tool 106. The surface unit 136 may be a computer stationed at the well site, a portable electronic device, a remote computer, or distributed between multiple locations and devices. The unit 136 may also be a control unit that controls functions of the equipment of the drill string 102.

Figure 2:
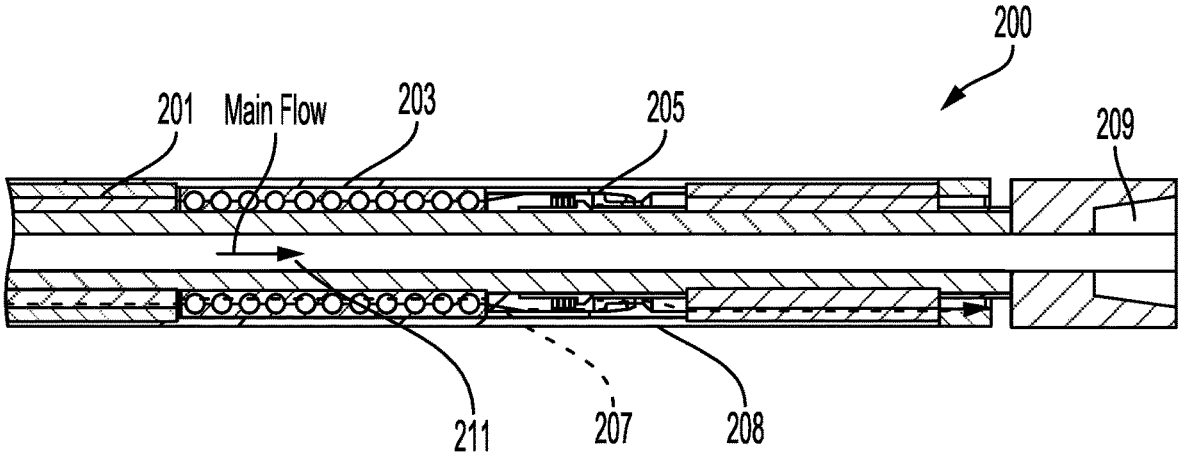
FIG. 2 is a schematic side-view of part of a drill string with a flow control choke having a curved interface according to one example of the present disclosure.

FIG. 2 is a schematic side-view of part of a drill string 200 with a flow control choke 205 having a curved interface according to one example of the present disclosure. The drill string may be disposed in a directional borehole 104, similar to the drill string 102 illustrated FIG. 1. The drill string includes radial bearings 201, a bearing assembly 203, a flow control choke 205, and a driveshaft 209. A main fluid flow path 211 within the drill string may be defined by a primary housing or driveshaft 209. A bypass flow path 207 within the drill string may be defined by a secondary housing 208.

The bypass flow path 207 for drilling fluid may control a flow of drilling fluid through the bearing assembly 203 of the drill string 200. An example of the bearing assembly 203 is a thrust-bearing stack. The main fluid flow path 211 may control the flow of drilling fluid through the primary housing or driveshaft 209. The flow of drilling fluid may turn the driveshaft 209.

The bearing assembly 203 may be shaped to restrict the flow of drilling fluid through the bypass flow path 207 via a tortuous flow path. The bypass flow path 207 may also divert the flow of drilling fluid through the flow control choke 205, which may control the flow of drilling fluid through the bypass flow path 207. The flow control choke 205 may control the flow of drilling fluid via the aperture defined by a space between a rotatable section and a stationary section of the flow control choke 205.

The flow control choke 205 is illustrated downhole from the bearing assembly 203 in FIG. 2. But, in other examples, the flow control choke 205 can be located uphole from the bearing assembly 203 for controlling the flow of drilling fluid. And, radial bearings 201 are illustrated upstream from the flow control choke 205. But, the radial bearings 201 can be located downstream from the flow control choke 205. The radial bearings 201, whether uphole or downhole of the bearing assembly, may restrict the flow of drilling fluid.

Figure 3:
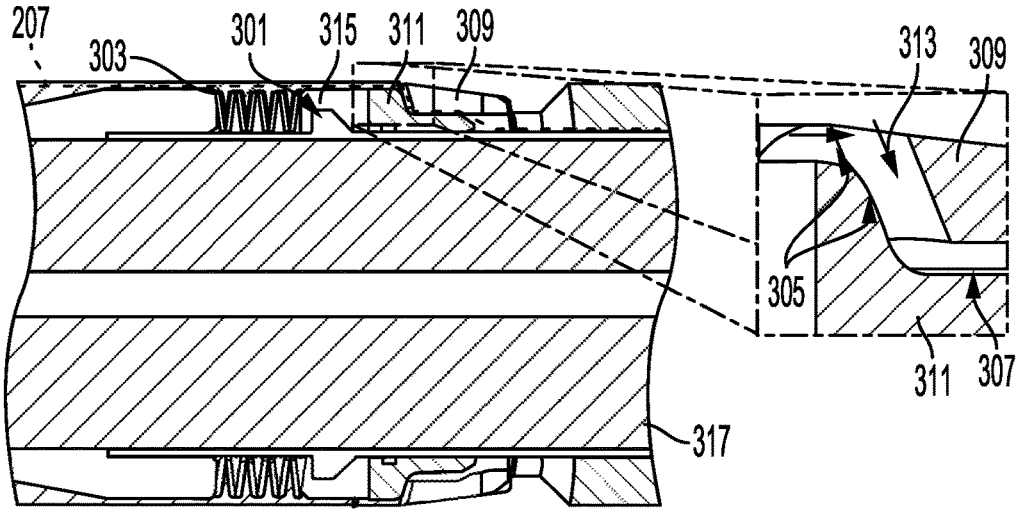
FIG. 3 is a schematic, cross-sectional view of a flow control choke with curved interfaces in part of the drill string according to one example of the present disclosure.

FIG. 3 is a schematic, cross-sectional view of the flow control choke 205 with curved interfaces in part of the drill string according to one example of the present disclosure.

The flow control choke 205 includes a rotatable section 311, a stationary section 309, a biasing mechanism 303 applying a biasing force to the rotatable section 311, and a slot 315 that may accept an anti-rotation tab 301.

The flow control choke 205 may be integrated into a portion of the drill string 200 as depicted in FIG. 2. The anti-rotation tab 301 may be secured to a driveshaft 317. The anti-rotation tab 301 may be accepted by a slot 315 within a rotatable section 311 of the flow control choke 205, which may prevent the rotatable section 311 from rotating relative to the driveshaft 317. The anti-rotational tab 301 is an example of a polygonal feature that may be secured to the driveshaft 317. The slot 315 is an example of an insert that may accept the polygonal feature. The polygonal feature that is secured to the driveshaft 317 may prevent the rotatable section from rotating relative to the driveshaft 317. Additional examples of the polygonal feature that may be secured to the driveshaft 317 can include, but are not limited to, at least one key, tooth, ridge, or spline. Additional examples of the insert that may accept the polygonal feature can include, but are not limited to, at least one groove, channel, or other opening that is defined by the rotatable section 311.

The rotatable section 311 can axially move along the bypass flow path 207. The rotatable section 311 can move to contact a stationary section 309, which may restrict a flow of drilling fluid through the bypass flow path 207. The biasing mechanism 303 may be positioned within the bypass flow path 207 to bias the rotatable section 311 into contact with the stationary section 309. An example of a biasing mechanism can include a retention spring. The rotatable section 311, in addition to a force of the biasing mechanism 303, may also be forced into the stationary section 309 by positive pressure from drilling fluid. The stationary section 309 may have a tapered portion arranged to maintain the position of the stationary section 309 in response to positive pressure from the drilling fluid as well as the force of the biasing mechanism 303.

The rotatable section 311 and the stationary section 309 may define a choked flow 313 through which the flow of drilling fluid can be controlled. The choked flow 313 can guide drilling fluid to a ledge 307 designed for erosion protection. For example, the shape of the ledge 307 may be designed to prevent the drilling fluid from impinging on a sleeve 308 positioned proximate to the flow control choke 205. The ledge 307 portion may have a minimum length that may be required for a high-speed jet flow of drilling fluid to become regularized such that the flow of drilling fluid through the flow control choke 205 may lose enough energy to prevent erosion on the sleeve 308 positioned proximate to the flow control choke 205. The ledge 307 may be coated with or may be constructed from a corrosion resistant material.

A curved interface 305 may be present between the rotatable section 311 and the stationary section 309. The curved interface 305 may be a juncture defined by a convex face of the rotatable section 311 and a convex face of the stationary section 309. In other examples, the curved interface may be a juncture defined by a convex face of the stationary section 309 and a concave face of the rotatable section 311. The curved interface may allow for a freedom of movement between a curved face of the rotatable section 311 and a curved face of the stationary section 309. The freedom of movement between the rotatable section 311 and the stationary section 309 may reduce wear on the flow control choke 205 when the flow control choke 205 experiences a bending or sheering force. Reduced wear on the flow control choke 205 may allow the flow control choke 205 to continue regulating the flow of drilling fluid through the bypass flow path 207.

Figure 4:
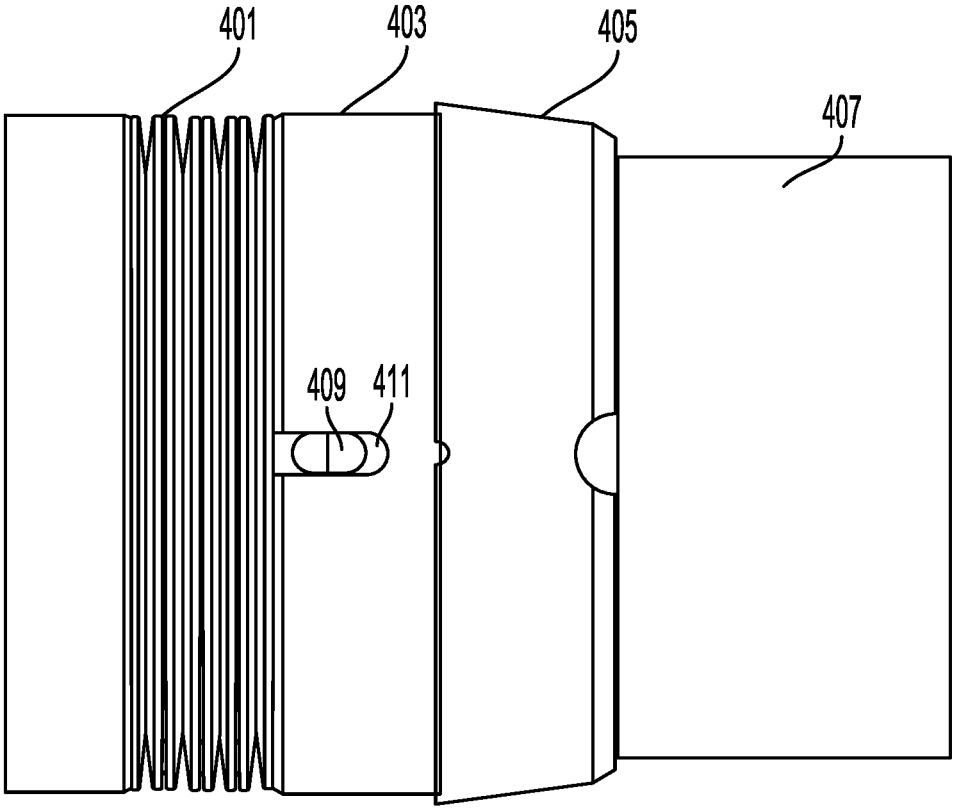
FIG. 4 is a side view of a flow control choke with a curved interface according to one example of the present disclosure.

FIG. 4 is a side view of a flow control choke with a curved interface according to one example of the present disclosure. The flow control choke with a curved interface includes an axial spring 401, a rotatable section 403, a stationary section 405, a sleeve 407 proximate to the stationary section, an anti-rotational tab 409, and a slot 411 that may be receive the anti-rotational tab 409.

An example of a biasing mechanism, the axial spring 401, may be located uphole of the rotatable section. Other examples of the biasing mechanism can include wave springs, compressed elastomers, and coil springs. In this example, the axial spring 401 may bias the rotatable section 403 of the flow control choke into the stationary section 405 of the flow control choke. The stationary section 405 may be downhole of the rotatable section 403. A slot 411 may be formed to accept an anti-rotation tab 409 to prevent the rotational motion of the rotatable section 403 with respect to a driveshaft. The slot 411 may be formed within the rotatable section 403. A sleeve 407 may extend downhole from the stationary section 405 of the flow control choke. This sleeve 407 may resemble the sleeve proximate to the ledge 307 illustrated in FIG. 3.

Figure 5:
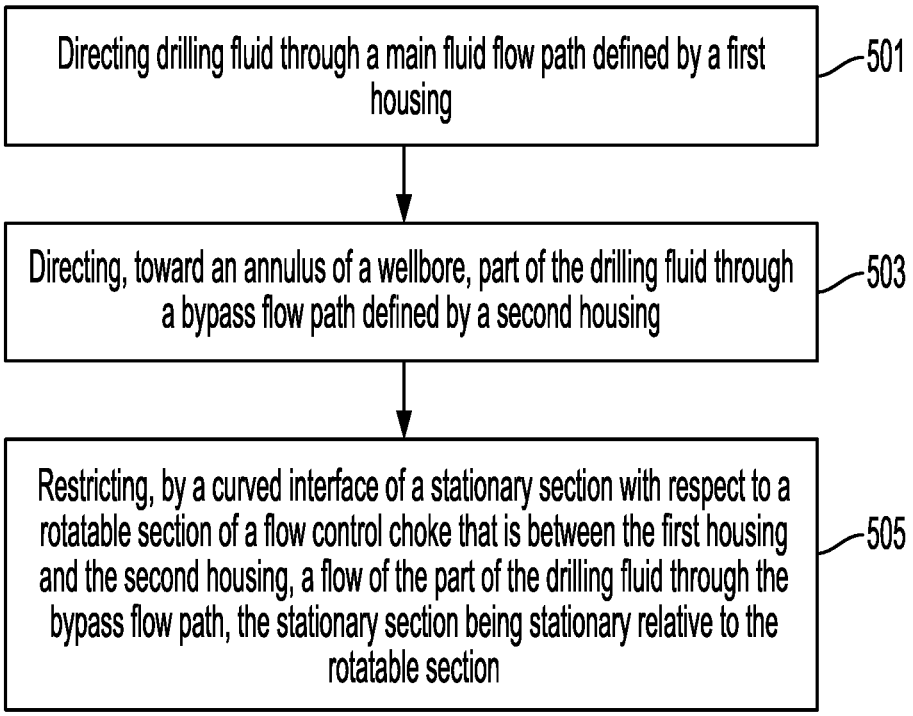
FIG. 5 is flow chart of a process for using a flow control choke with a curved interface for controlling fluid flow in a drilling assembly according to one example of the present disclosure.

FIG. 5 is flow chart of a process for using a flow control choke with a curved interface for controlling fluid flow in a drilling assembly according to one example of the present disclosure. The process shown in FIG. 5 can be used with the flow control choke 205 of FIGS. 2-4 or with other examples of a flow control choke 205 according to various aspects of the present disclosure.

In block 501, a flow of drilling fluid may be directed through a main fluid flow path defined by a first housing within a drill string. The main flow path may turn a driveshaft within a driveshaft housing, which may power a mud motor. The mud motor may displace rock and may use drilling fluid to carry rock fragments away from the mud motor as well as cool the mud motor.

In block 503, a part of the flow of drilling fluid may be directed toward an annulus of a wellbore, through a bypass flow path defined by a second housing within a drill string. The drilling fluid within the bypass flow path may lubricate bearings or bearing assemblies above the mud motor. The bearings or bearing assemblies may be present within the drill string to allow operation of the mud motor under the weight of steel pipe, tools, or other loads that may be present above the mud motor. The annulus of the wellbore may be defined as a space between the steel pipe, tools, and the drill string and a cement casing which may line the wellbore.

In block 503, the flow of drilling fluid may be restricted through a flow control choke. The flow control choke may have a curved interface between a rotatable section of the control choke and a stationary section of the flow control choke. Radial displacement of the rotatable section relative to the driveshaft powering the mud motor may be mitigated by an anti-rotation tab that may be secured to the driveshaft. The anti-rotation tab may be accepted by a slot within the rotatable section of the flow control choke.

In block 503, the rotatable section and the stationary section of the flow control choke may define a choked flow through which the flow of drilling fluid can be restricted. The rotatable section and the stationary section may be coated with a corrosion resistant material. Alternatively, the rotatable section and the stationary section may be made from the corrosion resistant material. The corrosion resistant material may prolong the life of the flow control choke, which may allow for a longer operation life of restricting drilling fluid flow into the annulus of the wellbore.

In block 503, the curved interface between the stationary section and the rotatable section may allow for a freedom of movement between the stationary section and the rotatable section. The freedom of movement that may be afforded by the curved interface may reduce wear or strain on the flow control choke should the flow control choke experience a bending or sheering force. Reduced wear or strain on the flow control choke from a bending or sheering force may allow for a longer operation life of the flow control choke.

In some aspects, systems, and a method for a flow control choke with curved interfaces for wellbore drilling operations are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a drilling system usable to drill a borehole, the drilling system comprising: a first housing defining a main fluid flow path; a second housing defining a bypass flow path toward an annulus of a wellbore; and a flow control choke between the first housing and the second housing, the flow control choke including a rotatable section and a stationary section that is stationary relative to the rotatable section, the stationary section having a curved interface with the rotatable section for restricting a flow of a drilling fluid through the bypass flow path.

Example 2 is the drilling system of example 1, further comprising an anti-rotation polygonal feature coupled to a driveshaft and an insert within the rotatable section, the insert configured to accept the anti-rotation polygonal feature and to prevent the rotatable section from rotating relative to the driveshaft.

Example 3 is the drilling system of example 1, wherein the flow control choke has a ledge portion to prevent the drilling fluid from impinging on a sleeve positioned proximate to the flow control choke.

Example 4 is the drilling system of example 1, further comprising: a driveshaft housing positioned within the main fluid flow path; a mud motor operable to turn a drill bit using the drilling fluid flowing through the driveshaft housing; and a bearing assembly shaped to restrict the flow of the drilling fluid through the bypass flow path, the bearing assembly being coupled to a downhole end of the mud motor and operable to support motion of the driveshaft within the driveshaft housing.

Example 5 is the drilling system of example 1, wherein the flow control choke comprises: a rotatable section axially movable within the bypass flow path to contact a stationary section and restrict the flow of the drilling fluid through the bypass flow path; and a biasing mechanism positioned within the bypass flow path to bias the rotatable section into contact with the stationary section.

Example 6 is the drilling system of example 1, wherein the stationary section has a tapered portion configured to maintain a position of the stationary section in response to positive pressure from the flow of the drilling fluid and pressure from a biasing mechanism.

Example 7 is the drilling system of example 1, wherein the rotatable section and the stationary section of the flow control choke are formed from a corrosion resistant material or a ductile metal with a corrosion resistant coating.

Example 8 is a method comprising: directing drilling fluid through a main fluid flow path defined by a first housing; directing, toward an annulus of a wellbore, part of the drilling fluid through a bypass flow path defined by a second housing; and restricting, by a curved interface of a stationary section with respect to a rotatable section of a flow control choke that is between the first housing and the second housing, a flow of the part of the drilling fluid through the bypass flow path, the stationary section being stationary relative to the rotatable section.

Example 9 is the method of example 8, further comprising preventing relative rotational movement between the rotatable section of the flow control choke and a driveshaft via a polygonal feature coupled to the driveshaft and that is received by an insert within the rotatable section.

Example 10 is the method of example 8, further comprising diverting the flow of the drilling fluid from the bypass flow path over a ledge of the flow control choke to prevent the flow of the drilling fluid from directly impinging on a sleeve proximate to the flow control choke.

Example 11 is the method of example 8, wherein the curved interface of the rotatable section of the flow control choke slides against the curved interface of the stationary section of the flow control choke in response to a bending force on the flow control choke.

Example 12 is the method of example 8, wherein restricting the flow of the drilling fluid through a plurality of bearings via the flow control choke results in a pressure of the drilling fluid flowing through a driveshaft housing that is sufficient to turn a drill bit of a mud motor.

Example 13 is the method of example 8, wherein a biasing mechanism coupled to the rotatable section of the flow control choke moves the rotatable section axially, towards the stationary section of the flow control choke, to restrict the flow of the drilling fluid through the bypass flow path.

Example 14 is a drilling system for drilling a borehole, the drilling system comprising: a drill string; a drill bit coupled to the drill string; a mud motor coupled to the drill string and operable to rotate the drill bit via a driveshaft; a bearing assembly coupled to a downhole end of the mud motor and operable to support the driveshaft, the bearing assembly comprising: a plurality of bearings positioned circumferentially around a bore of the bearing assembly; a first housing defining a main fluid flow path; a second housing defining a bypass flow path toward an annulus of a wellbore; and a flow control choke between the first housing and the second housing, the flow control choke including a rotatable section and a stationary section that is stationary relative to the rotatable section, the stationary section having a curved interface with the rotatable section for restricting a flow of a drilling fluid; and a motor steerable system coupled to the drill bit and operable to direct the drill bit in a direction.

Example 15 is the drilling system of example 14, wherein the plurality of bearings is configured to restrict the flow of drilling fluid via a tortuous flow path formed by the flow control choke.

Example 16 is the drilling system of example 14, further comprising an anti-rotation polygonal feature coupled to the driveshaft and an insert within the rotatable section, the insert configured to accept the anti-rotation polygonal feature and to prevent the rotatable section from rotating relative to the driveshaft.

Example 17 is the drilling system of example 14, wherein the curved interface of the rotatable section of the flow control choke is configured to slide against the curved interface of the stationary section of the flow control choke in response to a bending force on the flow control choke.

Example 18 is the drilling system of example 14, wherein the flow control choke has a ledge portion to prevent the flow of drilling fluid from impinging on a sleeve positioned proximate to the flow control choke.

Example 19 is the drilling system of example 14, wherein the stationary section has a tapered portion configured to maintain a position of the stationary section in response to positive pressure from the flow of drilling fluid and pressure from a biasing mechanism.

Example 20 is the drilling system of example 14, wherein the flow control choke comprises: a rotatable section axially movable within the bypass flow path to contact a stationary section and restrict the flow of the drilling fluid through the bypass flow path; and a biasing mechanism positioned within the bypass flow path to bias the rotatable section into contact with the stationary section.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A drilling system usable to drill a borehole, the drilling system comprising:

a first housing defining a main fluid flow path;

a second housing defining a bypass flow path toward an annulus of a wellbore; and a flow control choke between the first housing and the second housing, the flow control choke including a rotatable section and a stationary section that is stationary relative to the rotatable section, the stationary section having a curved interface with the rotatable section for restricting a flow of a drilling fluid through the bypass flow path, wherein the curved interface of the stationary section has a direction of concavity that is substantially parallel to the main fluid flow path, wherein the rotatable section is axially movable within the bypass flow path to contact the stationary section and to restrict the flow of the drilling fluid through the bypass flow path, and wherein a biasing mechanism is positioned within the bypass flow path to bias the rotatable section into contact with the stationary section.

2. The drilling system of claim 1, wherein the first housing comprises a driveshaft, the system further comprising an anti-rotation polygonal feature coupled to the driveshaft, and an insert within the rotatable section, the insert configured to accept the anti-rotation polygonal feature and to prevent the rotatable section from rotating relative to the driveshaft.

3. The drilling system of claim 1, wherein the flow control choke has a ledge portion to prevent the drilling fluid from impinging on a sleeve positioned proximate to the flow control choke.

4. The drilling system of claim 1, further comprising:

a mud motor operable to turn a drill bit using the drilling fluid; and a bearing assembly shaped to restrict the flow of the drilling fluid through the bypass flow path, the bearing assembly being coupled to a downhole end of the mud motor and operable to support motion of the driveshaft.

5. The drilling system of claim 1, wherein the stationary section has a tapered design configured to maintain a position of the stationary section in response to positive pressure from the flow of the drilling fluid and pressure from a biasing mechanism.

6. The drilling system of claim 1, wherein the rotatable section and the stationary section of the flow control choke are formed from a corrosion resistant material or a ductile metal with a corrosion resistant coating.

7. A method comprising:

directing drilling fluid through a main fluid flow path defined by a first housing;

directing, toward an annulus of a wellbore, part of the drilling fluid through a bypass flow path defined by a second housing; and restricting, by a curved interface of a stationary section with respect to a rotatable section of a flow control choke that is between the first housing and the second housing, a flow of the part of the drilling fluid through the bypass flow path, the stationary section being stationary relative to the rotatable section, wherein the curved interface of the stationary section has a direction of concavity that is substantially parallel to the main fluid flow path, wherein the rotatable section is axially movable within the bypass flow path to contact the stationary section and to restrict the flow of the drilling fluid through the bypass flow path, and wherein a biasing mechanism is positioned within the bypass flow path to bias the rotatable section into contact with the stationary section.

8. The method of claim 7, wherein the first housing comprises a driveshaft, the method further comprising preventing relative rotational movement between the rotatable section of the flow control choke and the driveshaft, via a polygonal feature coupled to the driveshaft and that is received by an insert within the rotatable section.

9. The method of claim 7, further comprising diverting the flow of the drilling fluid from the bypass flow path over a ledge of the flow control choke to prevent the flow of the drilling fluid from directly impinging on a sleeve proximate to the flow control choke.

10. The method of claim 7, wherein the curved interface of the rotatable section of the flow control choke slides against the curved interface of the stationary section of the flow control choke in response to a bending force on the flow control choke.

11. The method of claim 7, wherein restricting the flow of the drilling fluid through a plurality of bearings via the flow control choke results in a pressure of the drilling fluid that is sufficient to turn a drill bit via a mud motor.

12. The method of claim 7, wherein a biasing mechanism coupled to the rotatable section of the flow control choke moves the rotatable section axially, towards the stationary section of the flow control choke, to restrict the flow of the drilling fluid through the bypass flow path.

13. A drilling system for drilling a borehole, the drilling system comprising:

a drill string;

a drill bit coupled to the drill string;

a mud motor coupled to the drill string and operable to rotate the drill bit via a driveshaft;

a bearing assembly coupled to a downhole end of the mud motor and operable to support the driveshaft, the bearing assembly comprising:

a plurality of bearings positioned circumferentially around a bore of the bearing assembly, wherein the bore of the bearing assembly is positioned circumferentially around a main fluid flow path;

the driveshaft comprising a first housing defining the main fluid flow path;

a second housing defining a bypass flow path toward an annulus of a wellbore; and a flow control choke between the first housing and the second housing, the flow control choke including a rotatable section and a stationary section that is stationary relative to the rotatable section, the stationary section having a curved interface with the rotatable section for restricting a flow of a drilling fluid, wherein the curved interface of the stationary section has a direction of concavity that is substantially parallel to the main fluid flow path, wherein the rotatable section is axially movable within the bypass flow path to contact the stationary section and to restrict the flow of the drilling fluid through the bypass flow path, and wherein a biasing mechanism is positioned within the bypass flow path to bias the rotatable section into contact with the stationary section; and a motor steerable system coupled to the drill bit and operable to direct the drill bit in a direction.

14. The drilling system of claim 13, wherein the plurality of bearings is configured to restrict the flow of drilling fluid.

15. The drilling system of claim 13, further comprising an anti-rotation polygonal feature coupled to the driveshaft and an insert within the rotatable section, the insert configured to accept the anti-rotation polygonal feature and to prevent the rotatable section from rotating relative to the driveshaft.

16. The drilling system of claim 13, wherein the curved interface of the rotatable section of the flow control choke is configured to slide against the curved interface of the stationary section of the flow control choke in response to a bending force on the flow control choke.

17. The drilling system of claim 13, wherein the flow control choke has a ledge portion to prevent the flow of drilling fluid from impinging on a sleeve positioned proximate to the flow control choke.

18. The drilling system of claim 13, wherein the stationary section has a tapered design configured to maintain a position of the stationary section in response to positive pressure from the flow of drilling fluid and pressure from a biasing mechanism.

* * * * *